US005716162A

United States Patent [19]

Hodgson et al.

[11] Patent Number: 5,716,162

[45] Date of Patent: Feb. 10, 1998

[54] DUAL-STAGE MOUNTING SYSTEM FOR VIBRATORY COMPACTOR DRUM

[75] Inventors: Douglas A. Hodgson, Fuquay-Varina, N.C.; Shannon K. Sweeney, Erie, Pa.; Gregory A. Shives, Troy, Ohio

[73] Assignees: Lord Corporation, Cary, N.C.; Ingersoll-Rand, Shippensburg, Pa.

[21] Appl. No.: 580,226

[22] Filed: Dec. 28, 1995

[51] Int. Cl.[6] ..... E01C 19/28

[52] U.S. Cl. ..... 404/117; 404/122

[58] Field of Search ..... 404/117, 122, 404/132

[56] References Cited

U.S. PATENT DOCUMENTS

| | | | |
|---|---|---|---|
| 3,225,669 | 12/1965 | Green | 94/50 |
| 3,497,017 | 2/1970 | Goettl et al. | 173/18 |
| 3,505,885 | 4/1970 | Waschulewski et al. | 74/61 |
| 3,623,407 | 11/1971 | Dresher | 94/50 |
| 3,703,128 | 11/1972 | Fransson | 94/50 |
| 3,724,342 | 4/1973 | Caron et al. | 94/50 |
| 3,744,783 | 7/1973 | Mernyk | 267/136 |
| 3,843,275 | 10/1974 | Piatkowski et al. | 404/117 |
| 3,909,147 | 9/1975 | Takata | 404/117 |
| 3,966,344 | 6/1976 | Haker et al. | 404/117 |
| 4,195,947 | 4/1980 | Lambertz | 404/117 |
| 4,221,499 | 9/1980 | Breitholz et al. | 404/117 |
| 4,269,536 | 5/1981 | Goehler | 404/117 |
| 4,398,843 | 8/1983 | Bloom, Jr. | 404/117 |
| 4,577,995 | 3/1986 | Sadahiro | 404/117 |
| 4,619,552 | 10/1986 | Sadahiro | 404/117 |
| 4,647,247 | 3/1987 | Sandstrom | 404/75 |
| 4,732,507 | 3/1988 | Artzberger | 404/117 |
| 4,759,659 | 7/1988 | Copie | 404/117 |
| 4,927,289 | 5/1990 | Artzberger | 404/117 |
| 5,082,396 | 1/1992 | Polacek | 404/117 |
| 5,220,845 | 6/1993 | Anderson | 74/61 |
| 5,397,198 | 3/1995 | Bertrand | 404/117 |

*Primary Examiner*—James Lisehora

*Attorney, Agent, or Firm*—Richard K. Thompson; Randall S. Wayland; James W. Wright

[57] ABSTRACT

A dual-stage mounting system having an auxiliary support. A first set of elastomeric mounts connects the vibratory compactor drum to the auxiliary support and a second set of elastomeric mounts interconnect the auxiliary support to the vehicular frame. The dual-stage mounting system reduces by more than 70% the vibration transmitted from the drum to the primary support by a single-stage isolation mounting system thereby extending the life of the vehicle and improving operator comfort.

9 Claims, 7 Drawing Sheets

DUAL-STAGE MOUNTING SYSTEM FOR VIBRATORY COMPACTOR DRUM

BACKGROUND AND SUMMARY OF THE INVENTION

The present invention is directed to an improved isolation mounting system useful for vibratory compactor drums. More particularly, this invention is directed to a dual-stage isolation mounting system which provides significantly improved isolation between the compactor drum and its primary support structure.

Pavement or earth compactors include vehicles in which one or both sets of wheels are replaced with a rotary compactor drum mounted upon a frame or support. The vehicular frame includes a seat and controls for an operator. An eccentric weight rotates within the drum to generate the vibratory forces desired which are used to compact the surface in question. Conventionally, elastomeric mounts, or single-stage isolators, are used to mount the compactor roller to the primary support structure in an attempt to isolate the support and the operator from the vibratory forces.

Single-stage isolation mountings used to mount compactor drums to a support are capable of preventing up to 97% of the vibrational energy generated in the vibratory drum from making its way into the support. Still, the rotating eccentric employed to generate the vibrational energy is capable of generating such large amplitude vibrations that the residual vibration which does find its way into the support is capable of creating structural fatigue and causing fatiguing discomfort to the operator. Improved isolation capability is required for both extending the life of the equipment and enhancing the working conditions for the operator.

The present isolation mounting system provides the desired improvement using a dual-stage mounting. A first set of elastomeric isolator mounts connects the rotary compactor dram to an intermediate support structure and a second set of elastomeric isolator mounts connects the intermediate structure to the primary support structure (the frame). The intermediate support structure has significant mass, weighing as much as is practical, typically, between 20 and 40% of the weight of the compactor drum. The spring rate of the first set of isolator mounts is as low as practical, preferably no more than ½ the spring rate of the second set. The mass of the intermediate support and respective values of spring rates must be selected to prevent inordinate static deflection of the drum relative to the primary support structure while still enabling significantly improved isolation.

Various features, advantages and characteristics of the present invention will become apparent after a reading of the following detailed description thereof.

BRIEF DESCRIPTION OF THE DRAWINGS

The accompanying drawings depict the preferred embodiment(s) of the present invention, with like elements in various Figures bearing like reference numerals, in which.

DETAILED DESCRIPTION OF THE PREFERRED EMBODIMENTS

Figure 1:
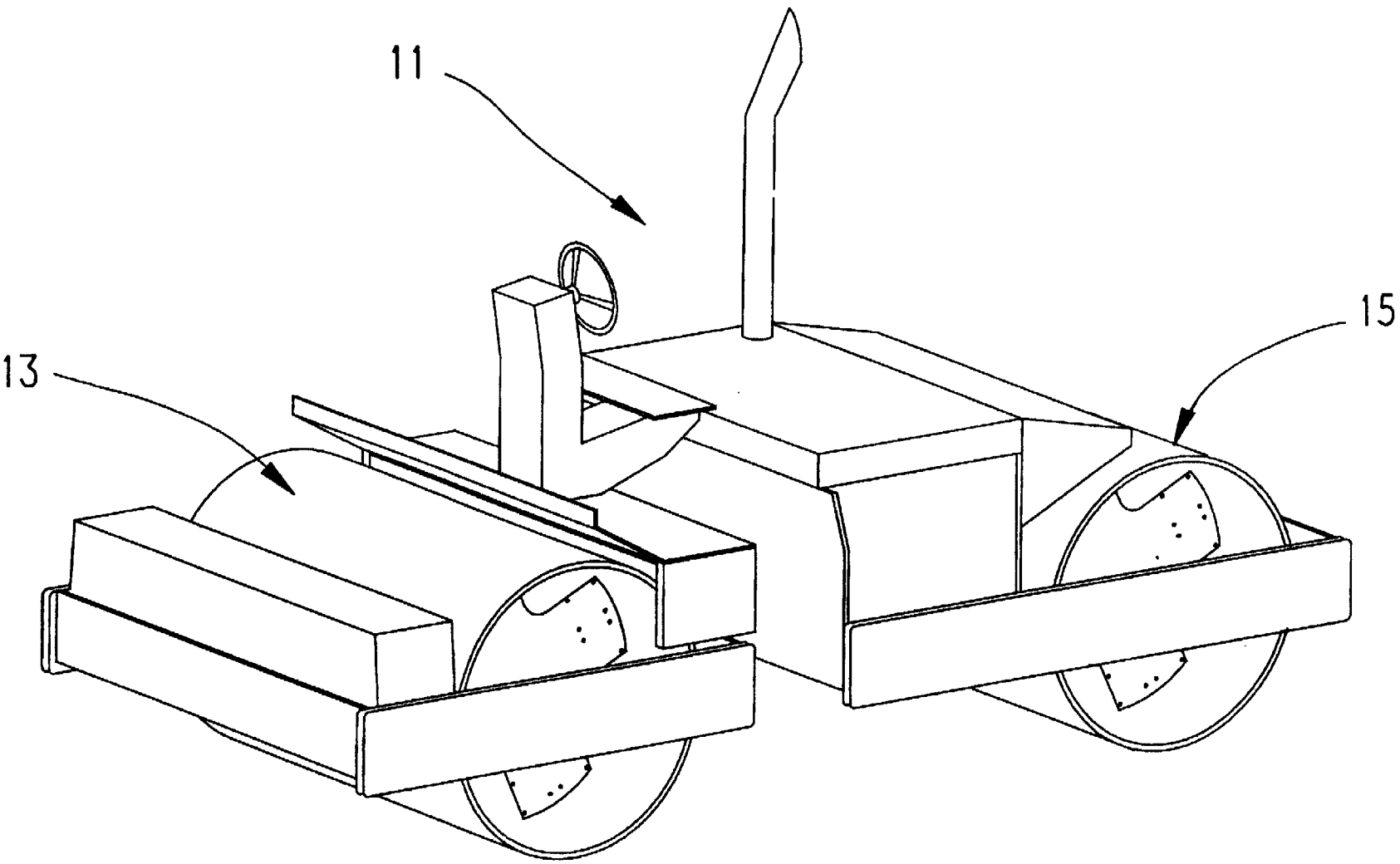
FIG. 1 is a perspective view of a typical asphalt compactor drum vehicle employing both a front and rear compactor drum.
Figure 3:
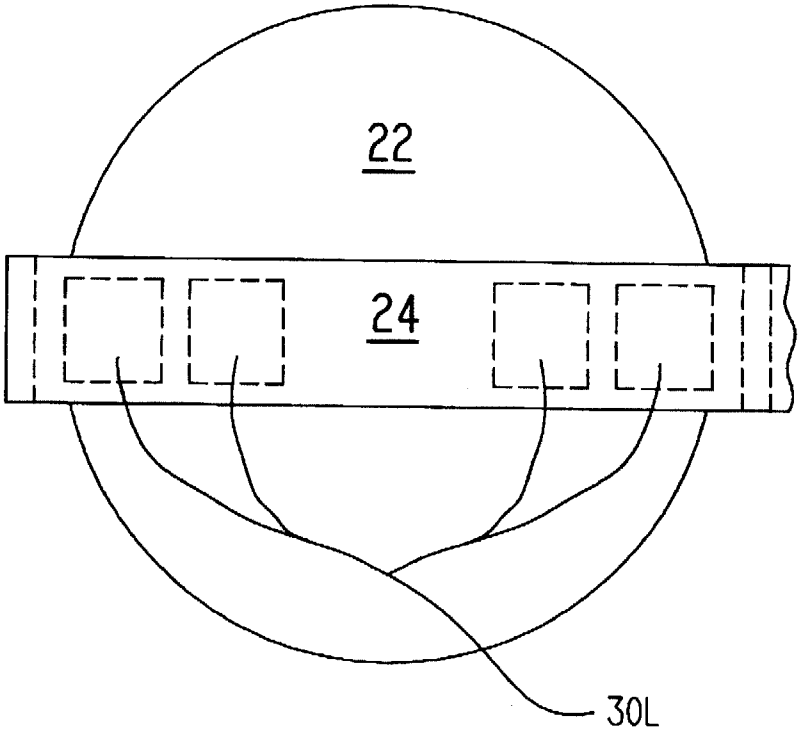
FIG. 3 is a diagrammatic side view of the compactor drum of FIG. 2.
Figure 2:
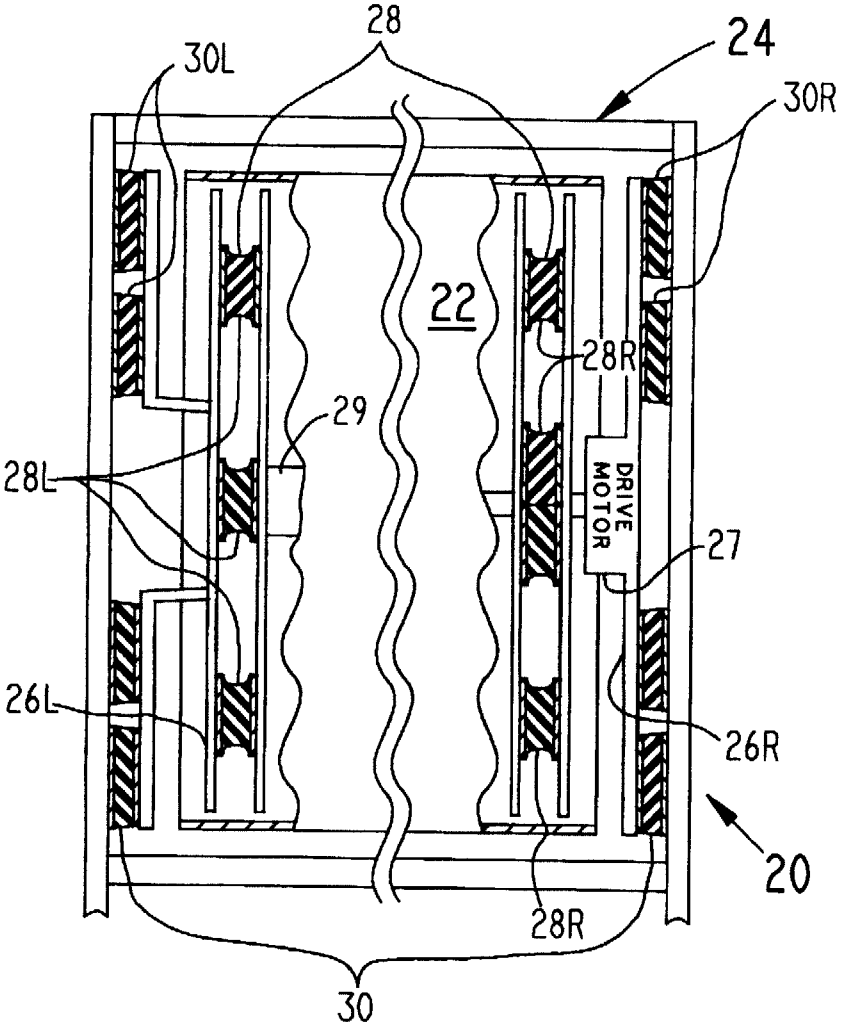
FIG. 2 is a schematic top view of a compactor drum employing the dual stage isolator of the present invention.
Figures 4A, 4B:
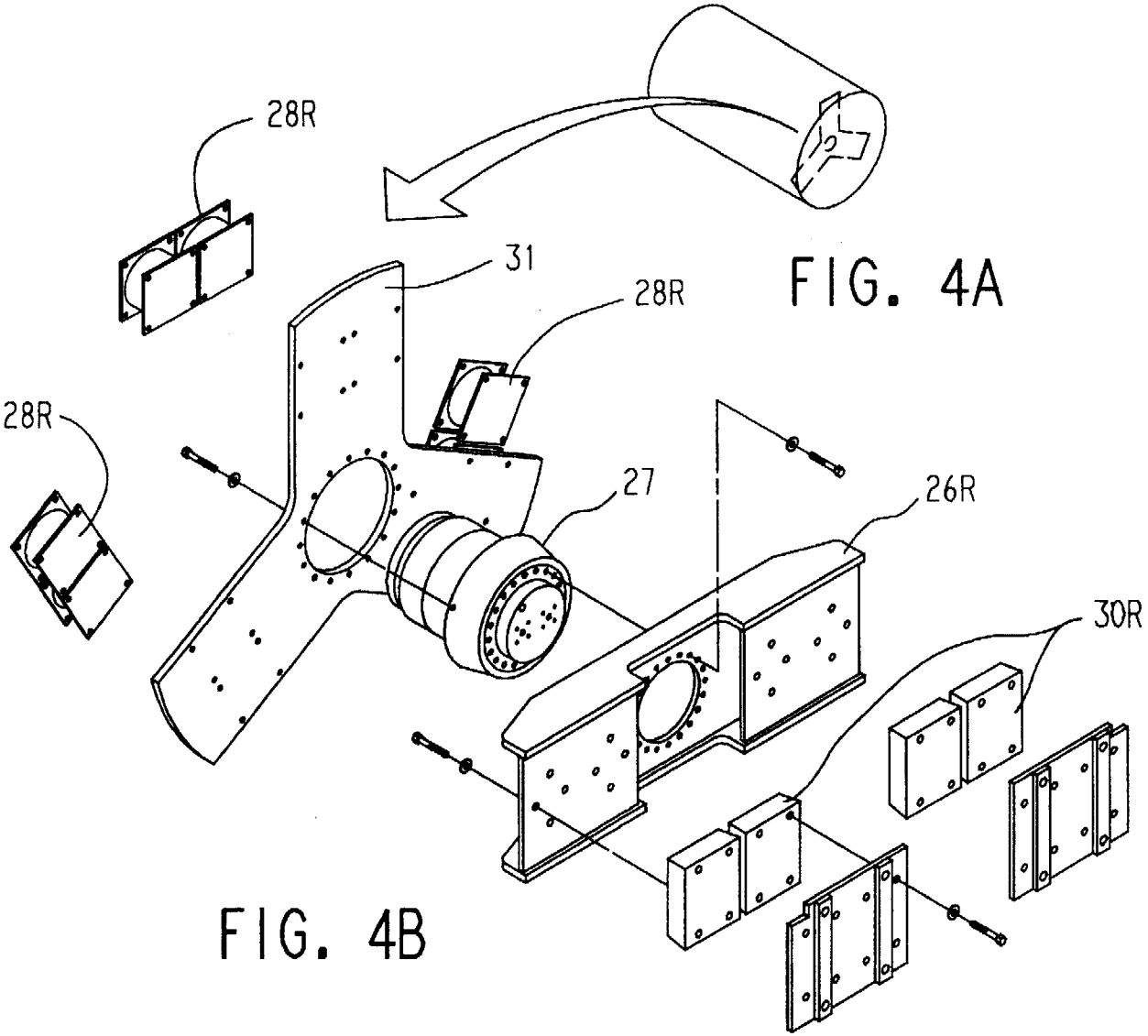
FIG. 4A is a schematic isometric detailing the position of a fast end of said compactor drum.
FIG. 4B is an exploded view of the isolator mounting on the first end of said compactor drum.
Figures 5A, 5B:
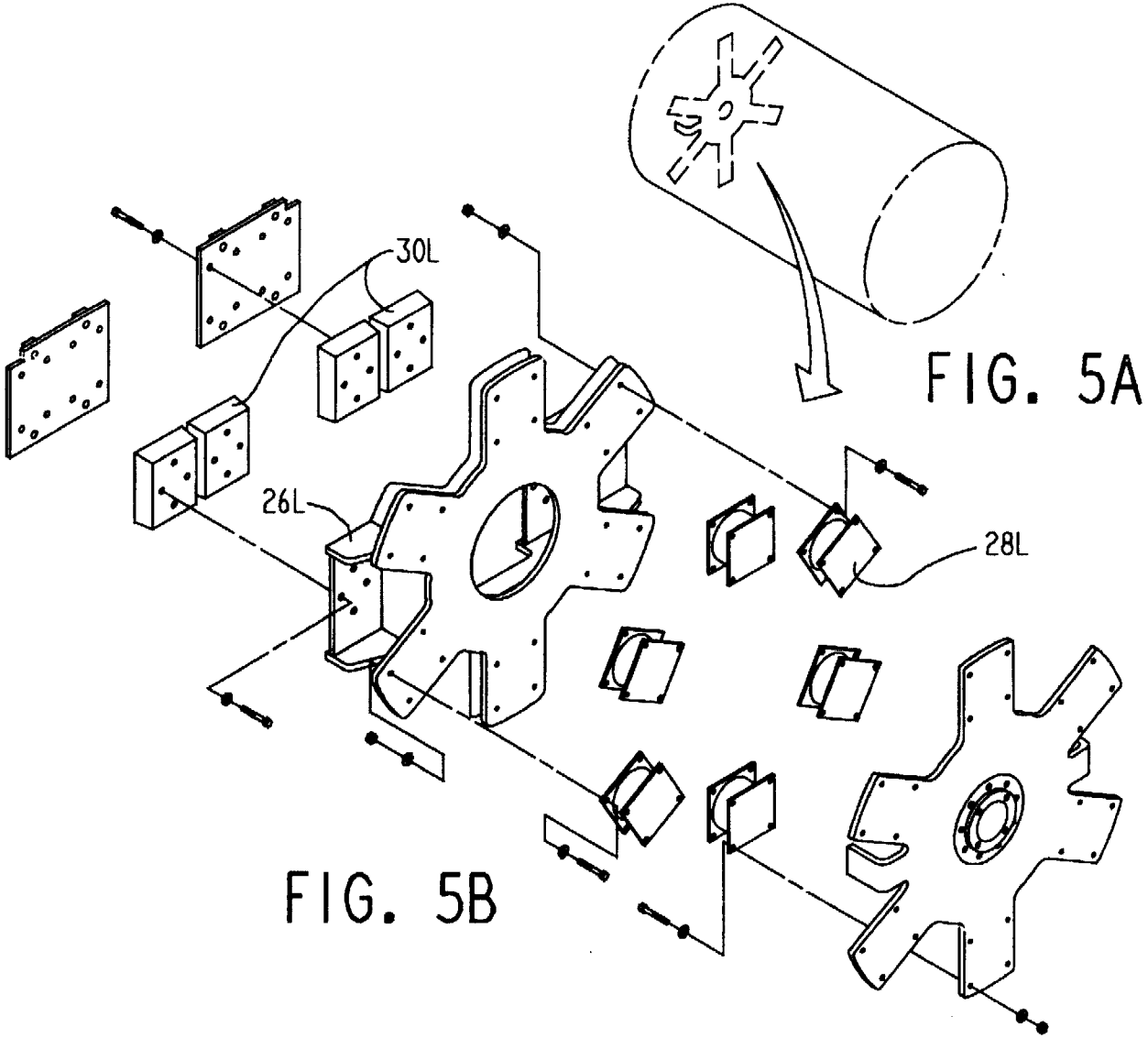
FIG. 5A is a schematic isometric detailing the position of a second end of said compactor drum.
FIG. 5B is an exploded view of the isolator mounting on the second end of said compactor drum.

A compactor vehicle of the type upon which one or more drums employing the dual-stage mounting system of the present invention is depicted in FIG. 1 generally at 11. The compactor vehicle 11 depicted here is an asphalt compactor having a front drum assembly 13 and a rear drum assembly 15. Similar vehicles for use in compacting earth have only a front compactor drum and pneumatic tires on the rear. Nonetheless, because of the additional force necessary to compact the earth surface and the more uneven nature thereof, the vibratory forces experienced by the primary support and the operator of such a vehicle can be even greater than those experienced on the featured vehicle. Accordingly, a dual-stage isolation mount of the type taught herein would be of significant benefit to the earth compactor vehicle, as well.

A dual-stage isolation mounting system of the present invention is depicted in detail in FIGS. 2–5 at 20. Compactor drum 22 is mounted within frame or primary support structure 24 by mounting system 20. Mounting system 20 includes an intermediate support structure 26 having a first portion 26R and a second portion 26L, with first portion 26R including the drive motor 27 for rotating the drum 22. Preferably, the relative masses or weights of 26R and 26L are substantially equal. Drum 22 has attached thereto a motor 29 which rotates an eccentric weight (not shown) which is inside the compactor drum 22 to cause vibratory motion thereof. A first set of elastomeric mounts 28 connect said drum 22 to the intermediate support structure 26 while a second set of elastomeric mounts 30 connect the intermediate support structure 26 to the primary support 24.

The first set of mounts 28 includes a first group 28R of mounts which, by way of example, could comprise three pairs of closely spaced mounts (FIG. 4) attached between two similarly shaped propeller-shaped plates 31 (only one shown). Obviously, other configurations of mounts could be used without affecting the invention. A second group 28L of mounts in the set 28 are positioned on the other side of drum 22 and attach drum 22 to intermediate structure 26L. A second set of mounts 30 include a third group 30R of mounts which interconnect intermediate support 26R to primary support structure 24 on the right side and a fourth group 30L of mounts which interconnect intermediate support 26L to primary support 24 on the left side of dram 22.

While the mounts of first and second sets 28 and 30 may be of whatever type desired and may be of the same general construction, as depicted here, the mounts of set 28 are depicted as model SMA070 and the mounts of set 30 are depicted as J-6332, both of which are available from Lord Corporation, one of the assignees of the present invention. Both mounts are of a sandwich construction having top and bottom plates which are readily boltable to adjacent supporting and supported structure. While the weight of the intermediate support 26 is preferably as large as practical, the upper limits can be expressed in terms related to the weight of the compactor drum 22. The intermediate support is preferably within the range of from about 20% to about 40% of the weight of drum 22, with the weight most preferably being about 24% of the drum's weight.

The stiffness of the second set of mounts is determined by practical considerations: the second set 30 of mounts must directly support the intermediate support 26 and indirectly support the drum 22. Accordingly, by way of example, the spring rate k of second set 30 of mounts can be about 40,000 lb/in. The spring rate of the first set 28 of mounts is preferably as soft as practical (i.e., limited by the desired maximum static deflection) and, preferably, in no event greater than one half of the value of the second set 30, in this example 20,000 lb/in., to provide optimum isolation.

Figure 6A:
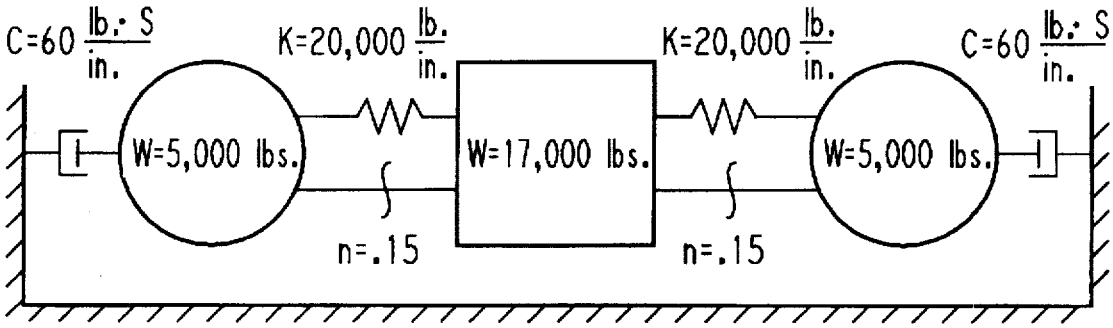
FIG. 6*a* is a fore and aft force analysis diagram for a single-stage suspension system.
Figure 6B:
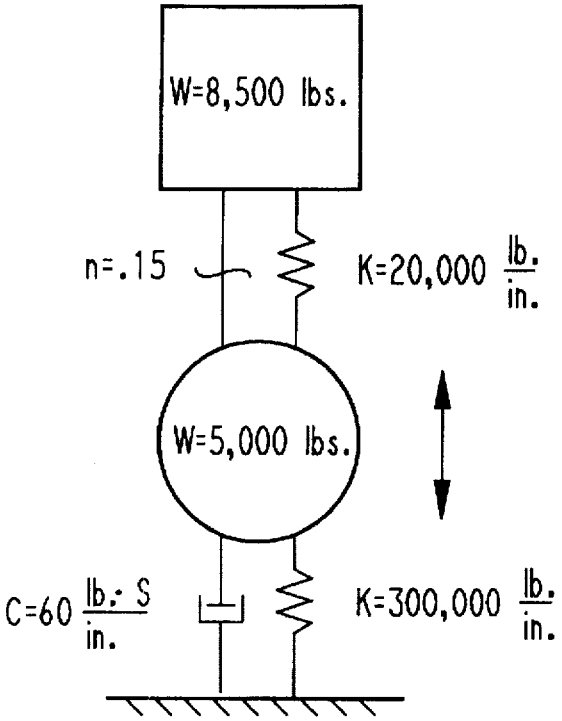
FIG. 6*b* is a vertical force analysis diagram for a single-stage suspension system.
Figure 7A:
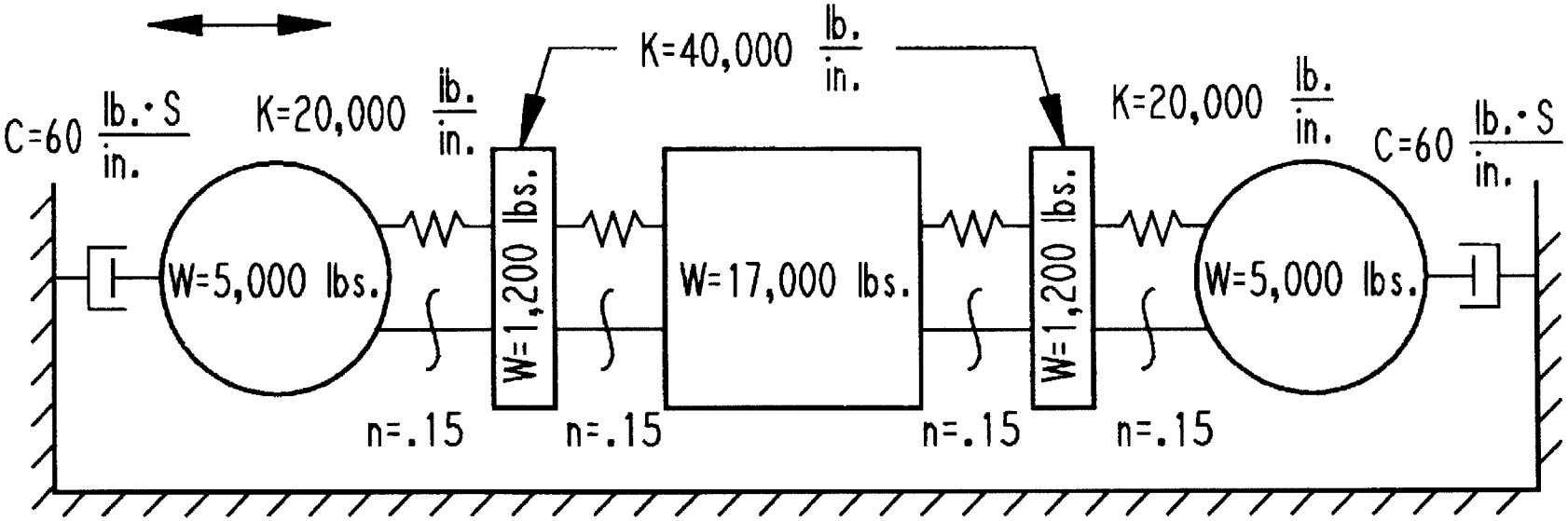
FIG. 7*a* is a fore and aft force analysis diagram for a dual-stage suspension system.
Figure 7B:
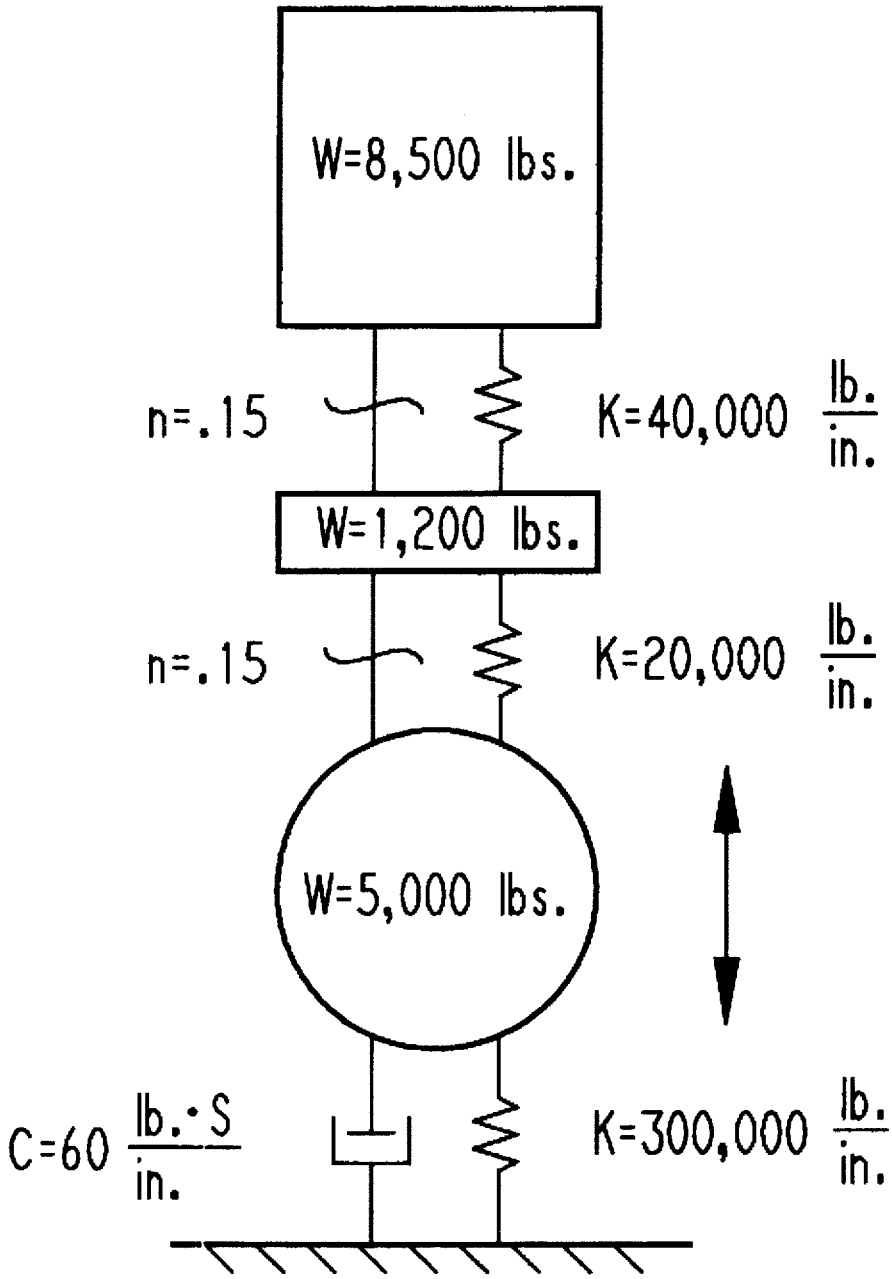
FIG. 7*b* is a vertical force analysis diagram for a dual-stage suspension system.

FIGS. 6*a* and 6*b* are diagrammatic models of the longitudinal and vertical forces acting in the single stage mount system of the prior art and FIGS. 7*a* and 7*b* diagram the dual-stage mounting system of the present invention. These figures indicate the weights W of the respective components, the spring rates k of the elastomeric elements and of the ground (arbitrarily chosen to have a spring rate of 300,000 lb/in.), the viscous loss element C of the ground, and the loss factor. Mathematical modeling was performed on these two systems and on a rigid mounting system (not shown) for purposes of comparison. The models provided the 97% reduction figure cited earlier of the single stage mount over the rigid mounting. The modeling also demonstrated that the single mounting system was 38% more efficient at directing vibrational energy into the surface being compacted than a rigid mounting. This is due to the fact that the vibration-inducing apparatus does not have to attempt to move as much of the structural support weight as the rigidly mounted system. The dual stage mount was yet again another improvement over the single stage, as will be discussed more fully hereinafter.

Actual figures from the modeling showed that the vertical g forces experienced by the frame were as follows:

rigid mount—2.203 single-stage isolation system—0.111 (95% reduction)

dual-stage isolation system—0.030 (an additional 73% reduction)

The fore-and-aft g forces were shown by the model to be as follows:

rigid mount—0.964 single-stage isolation system—0.072 (97% reduction)

dual-stage isolation system—0.020 (an additional 72% reduction)

The results of these mathematical models suggest that nearly ¾ of the vibration which would be transmitted by a single-stage system can be eliminated by the dual-stage system of the present invention. The vibrational energy is dissipated by shearing of the elastomeric portions of the associated mounts. This additional reduction will have significant benefits in both the life of the support structure (and, hence, the compactor vehicle) and in the operator comfort. These results were achieved at minimal cost: the static deflection, or sag, of the compacting roller relative to the frame is increased from about 0.68 in. to about 1.01 in. This minimal increase in static deflection will not have any significant impact the operation of the compactor vehicle.

Various changes, alternatives and modifications will become apparent to a person of ordinary skill in the art following a reading of the foregoing specification. It is intended that all such changes, alternatives and modifications as fall within the scope of the appended claims be considered pan of the present invention.

What is claimed is:

1. A dual-stage isolation mounting system for a rotary compactor drum used for compacting asphalt and earth, said isolation mounting system being adapted for use in vibrationally isolating a drum from a primary support structure interconnected thereto, said isolation mounting system comprising a) an intermediate support structure forming an auxiliary mass adapted for mounting external to said drum;

b) a first set of elastomeric isolation mounts adapted for interconnection between said drum and said intermediate support structure;

c) a second set of elastomeric isolation mounts adapted for interconnection between said intermediate support structure and said primary support structure; whereby significant vibratory energy is dissipated by deforming said first and second sets of elastomeric isolation mounts in shear minimizing an amount of vibrational energy transmitted from said rotary compactor drum to said primary support structure.

2. The isolation mount of claim 1 wherein said rotary compactor drum is vibrated by rotation of an eccentric weight internally within said drum.

3. The isolation mount of claim 2 wherein said mass of said intermediate support structure is selected to fall in a range of between about 20% and 40% of a mass of said rotary drum.

4. The isolation mount of claim 3 wherein the mass of said intermediate support structure is selected to be about one fourth the mass of said rotary drum.

5. The isolation mount of claim 3 wherein said mass of said intermediate support structure is divided substantially evenly into first and second portions adapted for attachment adjacent first and second ends of said drum, respectively.

6. The isolation mount of claim 5 wherein said first set of said elastomeric pads includes a first group of three pairs of elastomeric mounts adapted for attachment between said first end of said drum and a first end portion of said intermediate support structure, and a second group of six spaced elastomeric mounts adapted for attachment between said second end of said drum and a second end portion of said intermediate support structure.

7. The isolation mount of claim 6 wherein a drive motor forms part of said auxiliary mass and said drive motor rotates said compactor drum through said first group of three pairs of elastomeric mounts.

8. The isolation mount of claim 6 wherein said second set of elastomeric pads includes a third group of two pair of elastomeric mounts on said first end of said drum adapted for attachment between said intermediate support structure and said primary support structure and a fourth group of two pair of elastomeric mounts on said second end of said drum adapted for attachment between said intermediate support structure and said primary support structure.

9. The isolation mount of claim 8, wherein said first set of elastomeric mounts have a spring rate which is no greater than about one half the spring rate of said second set of elastomeric mounts.

* * * * *